US009505048B2

(12) United States Patent
Hwang et al.

(10) Patent No.: US 9,505,048 B2
(45) Date of Patent: Nov. 29, 2016

(54) PIPE MANUFACTURING METHOD AND HYDROFORMING MOLD THEREOF

(71) Applicant: INDUSTRIAL TECHNOLOGY RESEARCH INSTITUTE, Hsinchu (TW)

(72) Inventors: Yeong-Maw Hwang, Hsinchu (TW); Min-Tsang Chen, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 941 days.

(21) Appl. No.: 13/743,046

(22) Filed: Jan. 16, 2013

(65) Prior Publication Data

US 2014/0076016 A1 Mar. 20, 2014

(30) Foreign Application Priority Data

Sep. 14, 2012 (TW) ..... 101133734 A

(51) Int. Cl.
*B21D 26/043* (2011.01)
*B21D 26/033* (2011.01)
*B21D 26/047* (2011.01)

(52) U.S. Cl.
CPC ..... *B21D 26/043* (2013.01); *B21D 26/033* (2013.01); *B21D 26/047* (2013.01)

(58) Field of Classification Search
CPC .. B21D 26/02; B21D 26/033; B21D 26/037; B21D 26/039; B21D 26/043; B21D 26/045; B21D 26/047; B21D 22/125; B21C 37/294
See application file for complete search history.

(56) References Cited

U.S. PATENT DOCUMENTS 5,918,494 A * 7/1999 Kojima ..... B21D 26/033 72/58
6,029,487 A * 2/2000 Genin ..... B21D 26/045 72/58
6,202,460 B1 3/2001 Gardon
(Continued)

FOREIGN PATENT DOCUMENTS

CN 101172292 A 5/2008
DE 19733477 A1 2/1999
(Continued)

OTHER PUBLICATIONS

EPO English machine translation of DE 102006014272 B3.*
(Continued)

*Primary Examiner* — Moshe Wilensky
*Assistant Examiner* — Pradeep C Battula
(74) *Attorney, Agent, or Firm* — Birch, Stewart, Kolasch & Birch, LLP

(57) ABSTRACT

A hydroforming mold includes a lower die holder, a lower die, a pair of upper dies, a back pressure die, an upper die holder, and a pair of axial feed push rod assemblies. The lower die is disposed in a groove base of the lower die holder. A lower mold cavity for receiving a pipe blank is provided on the lower die. The two upper dies are clamped on the lower die, and can move along the top portion of the lower die. The back pressure die is disposed between the two upper dies. The axial feed push rod assemblies are respectively sealed at an end portion of the pipe blank and the two upper dies. Each of the axial feed push rod assemblies has a runner for introducing fluid into the pipe blank, so as to axially push the two upper dies to move close to each other.

17 Claims, 8 Drawing Sheets

(56) References Cited

U.S. PATENT DOCUMENTS

| | | | | |
|---|---|---|---|---|
| 6,237,382 | B1 | 5/2001 | Kojima et al. | |
| 6,497,128 | B1 * | 12/2002 | Canfield | B21D 26/037 29/421.1 |
| 6,578,400 | B1 * | 6/2003 | Bonny | B21D 26/037 72/58 |
| 7,337,641 | B1 | 3/2008 | Bruggemann | |
| 7,464,572 | B2 * | 12/2008 | Miyanaga | B21D 26/033 29/421.1 |
| 8,833,123 | B2 * | 9/2014 | Ogura | B21C 37/294 72/370.22 |
| 2009/0199402 | A1 | 8/2009 | Muroya et al. | |
| 2013/0185974 | A1 * | 7/2013 | Colmano | B21D 26/033 42/49.1 |

FOREIGN PATENT DOCUMENTS

| | | | | |
|---|---|---|---|---|
| JP | 2001-300652 | A | 10/2001 | |
| JP | 2002-153917 | A | 5/2002 | |
| JP | 2004-17107 | A | 1/2004 | |
| JP | 5016174 | B2 | 9/2012 | |
| KR | DE 102006014272 | B3 * | 9/2007 | B21D 26/043 |
| TW | I298655 | B | 7/2008 | |
| TW | I314077 | | 9/2009 | |
| TW | 201122386 | A1 | 7/2011 | |
| WO | WO 01/62410 | A2 | 8/2001 | |

OTHER PUBLICATIONS

"Design and manufacture of a tube hydroforming testing machine", Jul. 2003, 102 pages.

Hwang et al., "Finite Element Analysis of Tube Hydroforming for Asymmetric Shape Products", 2010 Conference on Precision Machinery and Manufacturing Technology-PMMT 2010, 6 pages.

Sato et al., "Tube Hydroforming With Movable Dies", 4th International Conference on Tube Hydroforming (Tubehydro 2009), Sep. 6-9, 2009, 7 pages.

* cited by examiner

PIPE MANUFACTURING METHOD AND HYDROFORMING MOLD THEREOF

CROSS-REFERENCE TO RELATED APPLICATION

This application claims the benefit of Taiwan Patent Application No. 101133734, filed on Sep. 14, 2012, which is hereby incorporated by reference for all purposes as if fully set forth herein.

TECHNICAL FIELD

The technical field relates to a pipe manufacturing method and a hydroforming mold thereof.

BACKGROUND

Hydroformed pipes are widely applied to processing and manufacturing of automobile parts, so as to reduce the weight and increase rigidity. However, pipes with a great expansion rate, such as exhaust pipes and silencers, are produced through spinning or welding, thereby lowering production rate and having poor rigidity.

When a pipe with an inclined expansion is hydroformed using a fixed forming mold in the prior art, severe friction is generated between a metal pipe blank and an upper die of the fixed forming mold, and the metal pipe blank cannot extend smoothly. As a result, the thickness of a wall of the pipe with an inclined expansion is uneven, buckling and wrinkling are generated, and the pipe wall at the protrusion area may break as the wall is excessively thin.

SUMMARY

According to one embodiment, a hydroforming mold for forming pipes is provided. The hydroforming mold includes a lower die holder, a lower die, a pair of upper dies, a back pressure die, an upper die holder, and a pair of axial feed push rod assemblies.

The lower die holder has a groove base. The groove base includes a bottom plane and two side planes adjoining the bottom plane. The lower die is disposed on the bottom plane. A lower mold cavity for receiving the pipe blank is provided on a top portion of the lower die. The pair of upper dies is clamped on the top portion of the lower die, and can move along the top portion of the lower die. A bottom portion of each upper die is provided with an upper mold cavity. An inward slope is formed on a side of each upper mold cavity opposite to the other upper die.

The back pressure die is disposed between the two upper dies, and has a frame and two pressing portions. The frame has a guide rod parallel to an axial direction of the pipe blank. Each pressing portion is provided with a guide hole, and the guide hole is sleeved on the guide rod, so that the two pressing portions move relative to the frame. Bottom surfaces of the two pressing portions lean against a surface of the pipe blank.

The upper die holder is covered on the lower die holder to prevent the pair of upper dies from moving away from the lower die. A position on the upper die holder corresponding to the back pressure die is provided with a window, so as to form a space that allows the back pressure die to move away from the lower die.

The pair of axial feed push rod assemblies is sealed at an end portion of the pipe blank and the pair of upper dies. The pair of axial feed push rod assemblies has a runner for introducing fluid into the pipe blank, so as to axially push the pair of upper dies to move close to each other.

According to another embodiment, a pipe manufacturing method for forming pipes is provided. The pipe manufacturing method includes the following steps. The above hydroforming mold of a pipe with an inclined expansion is provided, and a pipe blank is put into the lower mold cavity and the upper mold cavity. The fluid runs through the runner and fills the pipe blank. A first fixed pressure is applied on the fluid. The pair of axial feed push rod assemblies moves the pair of upper dies in an axial direction with a pushing speed, and axially presses the pipe blank. Meanwhile, the first fixed pressure of the fluid is maintained. The pipe blank bulges and pushes up the back pressure die. The pair of axial feed push rod assemblies stops pushing after moving for a stroke. At the same time, a second fixed pressure is applied on the fluid, where the first fixed pressure is smaller than the second fixed pressure. The pipe is formed.

DETAILED DESCRIPTION

In order to make the features of the disclosure clearer, embodiments of the disclosure are described in detail below with reference to the accompanying drawings.

First of all, the embodiment illustrates a hydroforming mold 2, which is used to form a pipe with an inclined expansion 4.

Figure 1:
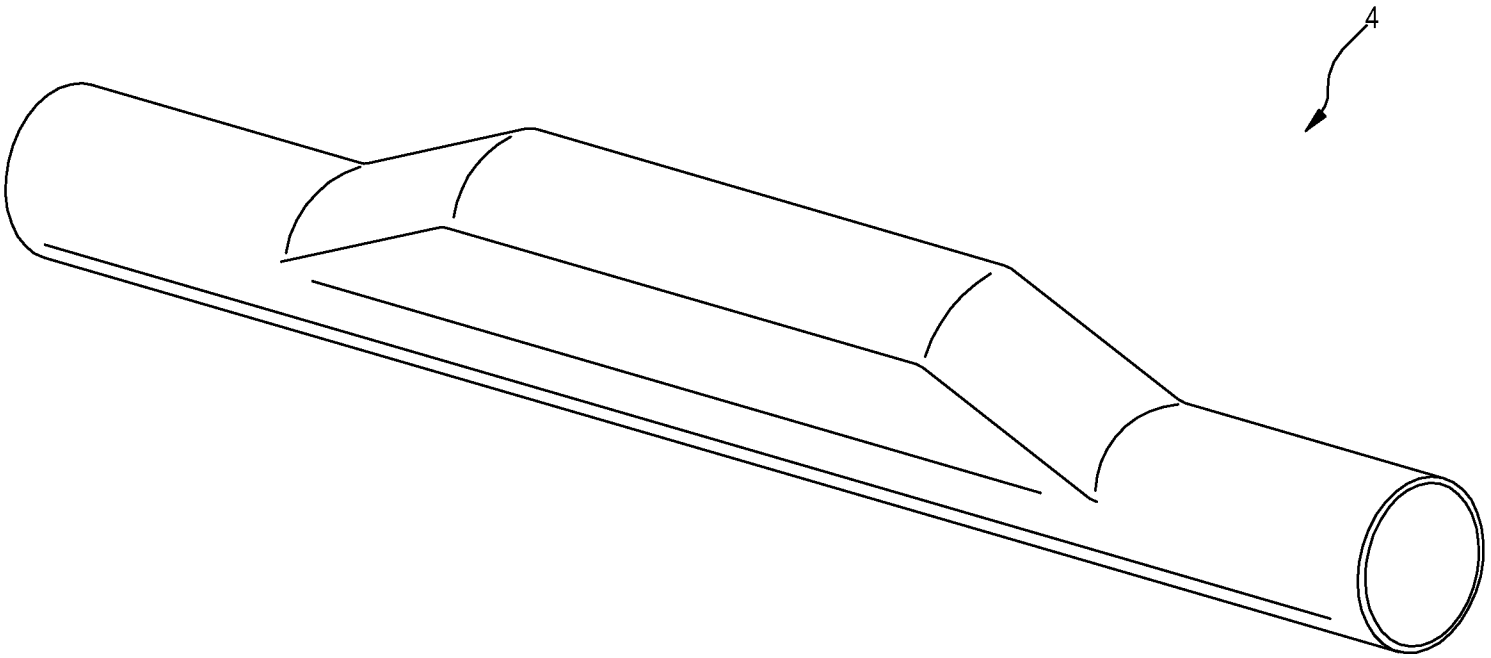
FIG. 1 is a three-dimensional view of a pipe with an inclined expansion.

Referring to FIG. 1, FIG. 1 is a three-dimensional view of a pipe with an inclined expansion 4, namely, the pipe with an inclined expansion 4 produced by using the hydroforming mold of this embodiment.

Figure 2:
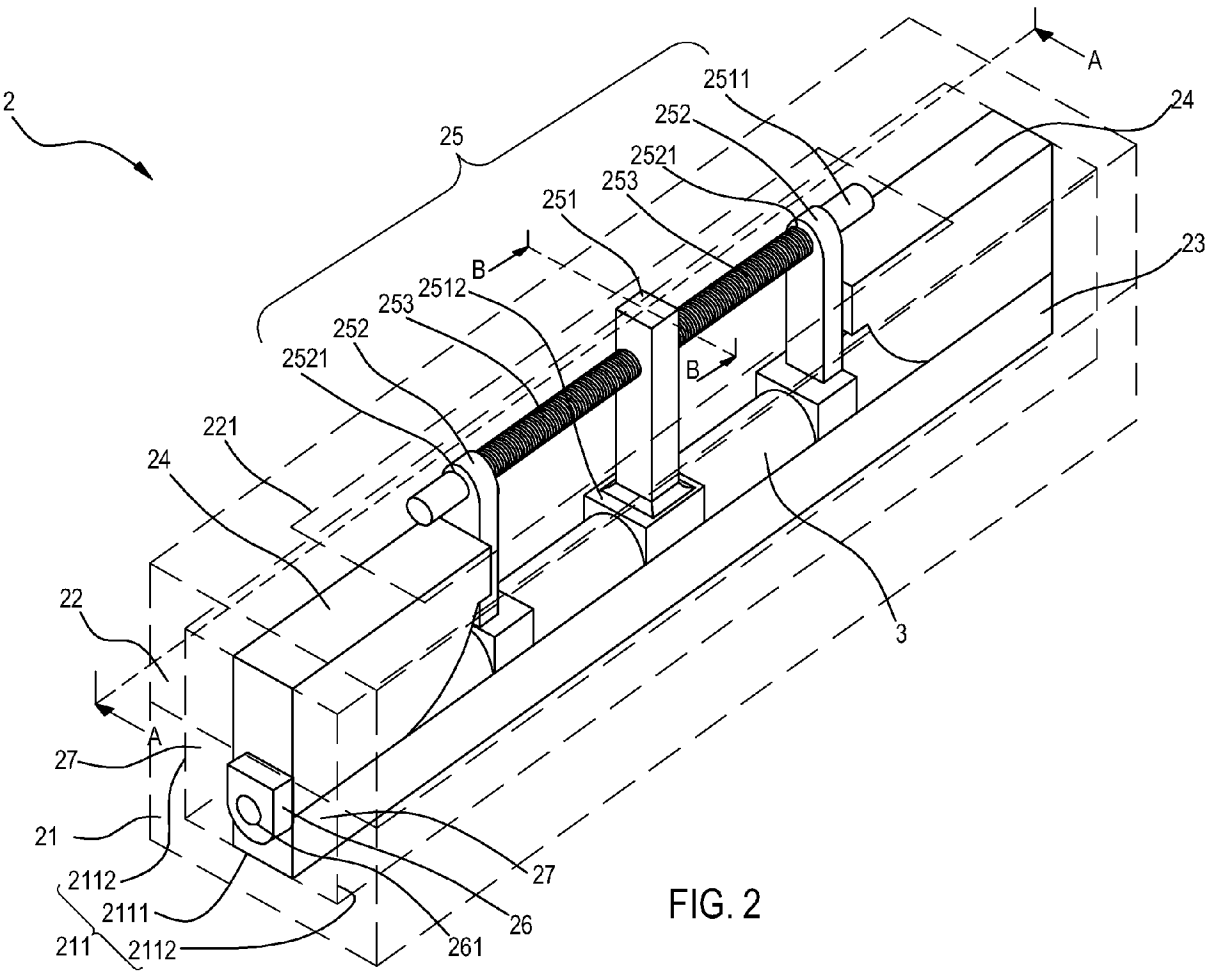
FIG. 2 is a three-dimensional view of a hydroforming mold of a pipe with an inclined expansion according to an embodiment.

FIG. 2 is a three-dimensional view of a hydroforming mold 2 of a pipe with an inclined expansion 4 according to the embodiment. In this embodiment, the hydroforming mold 2 includes a lower die holder 21, a lower die 23, a pair of upper dies 24, a back pressure die 25, an upper die holder 22 and a pair of axial feed push rod assemblies 26.

The lower die holder 21 has a groove base 211. In this embodiment, the groove base 211 has an upward opening. The groove base 211 includes a bottom plane 2111 and two side planes 2112 adjoining the bottom plane 2111.

The lower die 23 is disposed on the bottom plane 2111. A pipe blank 3 used to form the pipe with an inclined expansion 4 through hydroforming is disposed inside the lower die 23. The pipe blank 3 adopts a material applicable to the pipe hydroforming technology, which should have a desirable extensibility, and is mainly a material processed by cold press molding, such as a metal material. Currently, the material of the pipe blank 3 is mainly carbon steel, alloy steel, stainless steel, aluminum alloy, and copper alloy.

The two upper dies 24 are respectively clamped at two ends of a top portion of the lower die 23, and can move along the top portion of the lower die 23.

The back pressure die 25 is disposed between the two upper dies 24, and has a frame 251 and two pressing portions 252. The frame 251 has a guide rod 2511 parallel to an axial direction of the pipe blank 3. Each pressing portion 252 is provided with a guide hole 2521. The guide hole 2521 is sleeved on the guide rod 2511 so that the two pressing portions 252 move relative to the frame 251. Bottom surfaces of the two pressing portions 252 lean against an upper surface of the pipe blank 3. Further, the guide rod 2511 may be a round rod.

The upper die holder 22 is covered on the lower die holder 21 to prevent the two upper dies 24 from moving away from the lower die 23. In this embodiment, the two upper dies 24 are prevented from moving upward. A position on the upper die holder 22 corresponding to the back pressure die 25 is provided with a window 221, so as to form a space that allows the back pressure die 25 to move away from the lower die 23. In this embodiment, the space that allows the back pressure die 25 to move upward is formed.

In this embodiment, the terms "upper" and "lower" in the lower die holder 21 and upper die holder 22, and in the lower die 23 and upper die 24 are merely used to express the relationship of these components, but are not intended to limit the spatial positions thereof. In another embodiment, the lower die holder 21 and the lower die 23 can also be disposed above the upper die holder 22 and the upper die 24.

Figure 3:
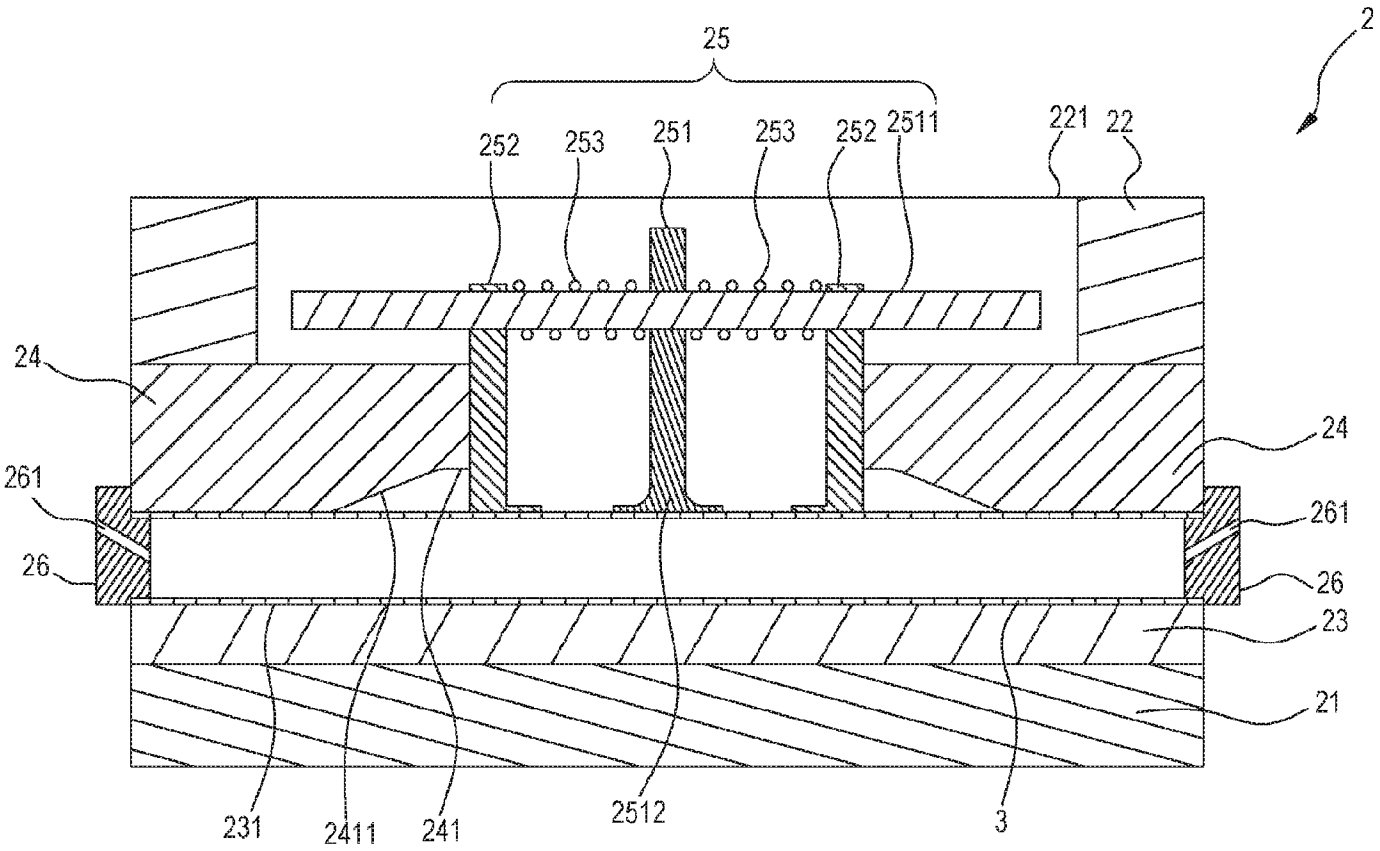
FIG. 3 is sectional view of a mold along line A-A before a pipe with an inclined expansion is hydroformed according to an embodiment.

FIG. 3 is a sectional view of a hydroforming mold 2 along line A-A before a pipe with an inclined expansion 4 is hydroformed. According to FIG. 3, the top portion of the lower die 23 is provided with a lower mold cavity 231 for receiving the pipe blank 3. A bottom portion of each upper die 24 is provided with an upper mold cavity 241. An inward slope 2411 is formed on a side of each upper mold cavity 241 opposite to the other upper die 24. The frame 251 further includes a saddle portion 2512. The saddle portion 2512 is disposed on a bottom surface of the frame 251, and leans against the upper surface of the pipe blank 3. A gap is maintained between the saddle portion 2512 and the bottom surfaces of the two pressing portions 252.

The back pressure die 25 further includes two elastic elements 253. The two elastic elements 253 are symmetrically sleeved on the guide rod 2511 at two sides of the frame 251, and are respectively located between the frame 251 and the two pressing portions 252, that is, a gap is maintained between the bottom surfaces of the two pressing portions 252. The two elastic elements 253 may be springs, spring leafs, rubber, and so on. Further, the elastic element 253 may be a compression spring.

The pair of axial feed push rod assemblies 26 is sealed on two ends of the pipe blank 3 and the two upper dies 24. The pair of axial feed push rod assemblies 26 has a runner 261 for introducing fluid into the pipe blank 3. During hydroforming on the pipe blank 3, the pair of axial feed push rod assemblies 26 pushes the upper dies 24 and the two ends of the pipe blank 3 at the same time, so as to axially press the pipe blank 3.

Figure 4:
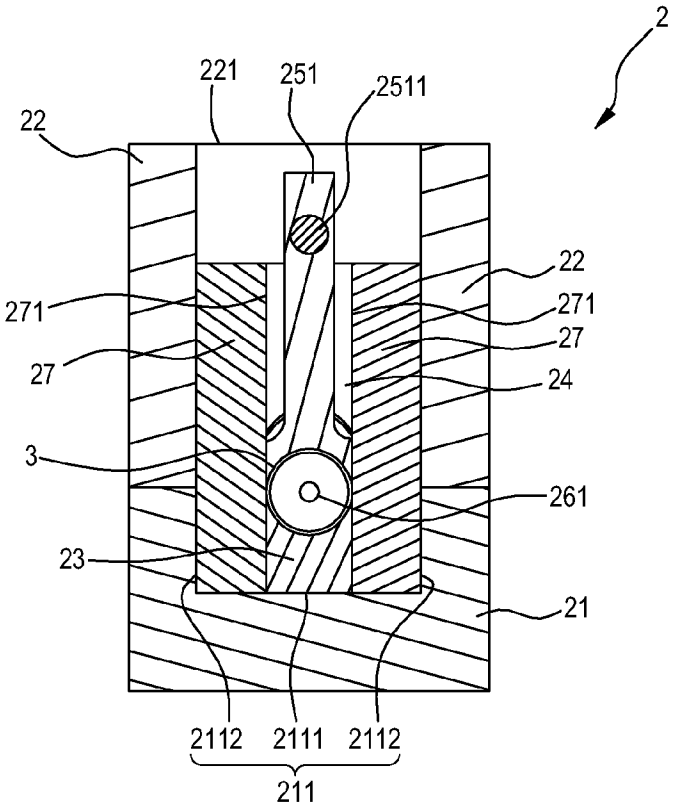
FIG. 4 is sectional view of a mold along line B-B before a pipe with an inclined expansion is hydroformed according to an embodiment.

FIG. 4 is a sectional view of a hydroforming mold 2 along line B-B before a pipe with an inclined expansion 4 is hydroformed. According to FIG. 4, the hydroforming mold 2 further includes two plates 27, which are respectively disposed between two external sides of the lower die 23 and the two side planes 2112 of the groove base. Two opposite surfaces of the two plates 27 form two guide surfaces 271 for movement of the two upper dies 24 and the two pressing portions 252. Referring to FIG. 3 and FIG. 4, the two plates 27 are fixed through the upper die holder 22, so as to prevent the two upper dies 24 from moving away from the lower die 23. In this embodiment, the two upper dies 24 are prevented from moving upward.

The two plates 27 are used to fix the two upper dies 24 and the lower die 23. If the radius of the pipe 4 changes, the two upper dies 24, the lower die 23, the back pressure die 25 and the two plates 27 need to be changed, while the upper die holder 22 and the lower die holder 21 do not need to be changed, thereby saving the cost of the mold. In addition, if the width of the two upper dies 24 and the lower die 23 is designed to be the same as that of the groove base 211 of the lower die holder 21, the two plates 27 can be replaced directly.

Figure 5:
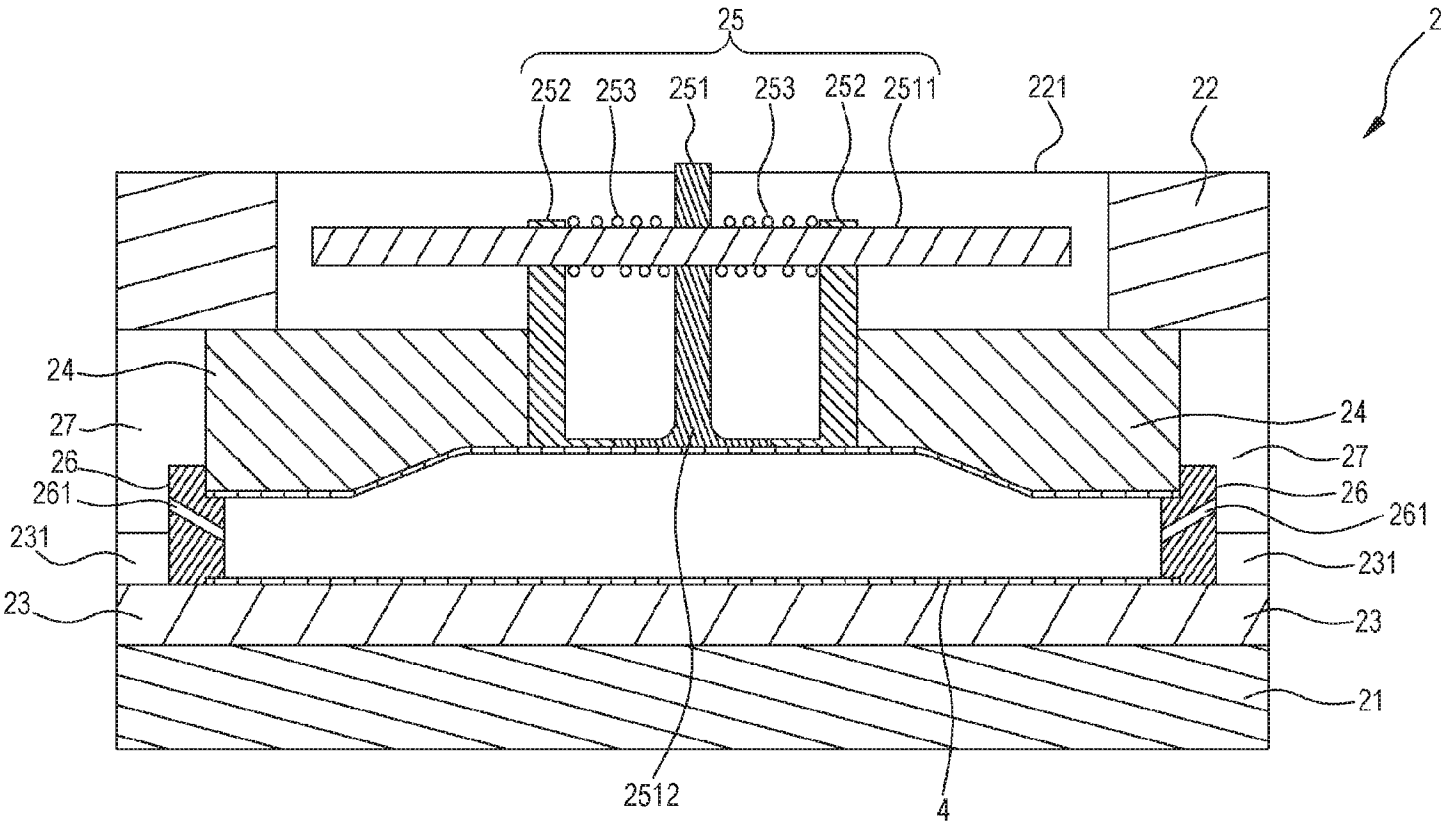
FIG. 5 is sectional view of a mold along line A-A after a pipe with an inclined expansion is hydroformed according to an embodiment.

FIG. 5 is a sectional view of a hydroforming mold 2 along line A-A after a pipe with an inclined expansion 4 is hydroformed. Through comparison of FIG. 3 and FIG. 5, it can be known that during hydroforming on the pipe blank 3, the pair of axial feed push rod assemblies 26 pushes the two upper dies 24 and the pipe blank 3 to the frame 251 at the same time, and the two pressing portions 252 are pushed by the two upper dies 24 and move toward the frame 251.

The two elastic elements 253 symmetrically sleeved on the guide rod 2511 at the two sides of the frame 251 have the same elastic force. When the two pressing portions 252 move toward the frame 251, the two elastic elements 253 maintain the frame 251 at the center of the back pressure die 25.

Figure 6:
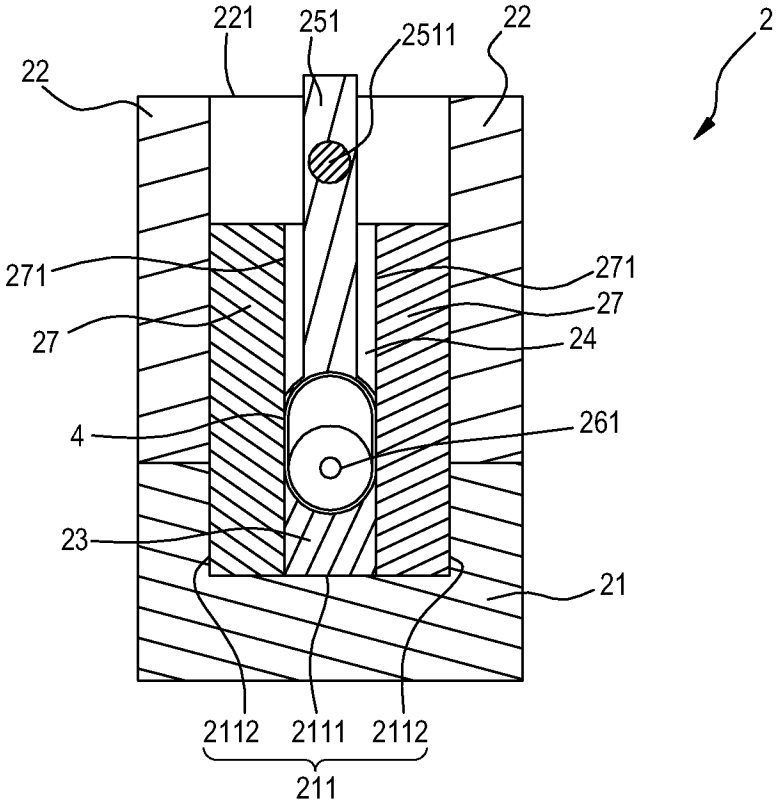
FIG. 6 is sectional view of a mold along line B-B after a pipe with an inclined expansion is hydroformed according to an embodiment.

FIG. 6 is a sectional view of a hydroforming mold 2 along line B-B after a pipe with an inclined expansion 4 is hydroformed. Through comparison of FIG. 4 and FIG. 6, it can be known that, during hydroforming on the pipe blank 3, the back pressure die 25 is pushed upward as the pipe blank 3 bulges.

The embodiment also provides a pipe manufacturing method, which is applicable to form a pipe with an inclined expansion 4.

Figure 7:
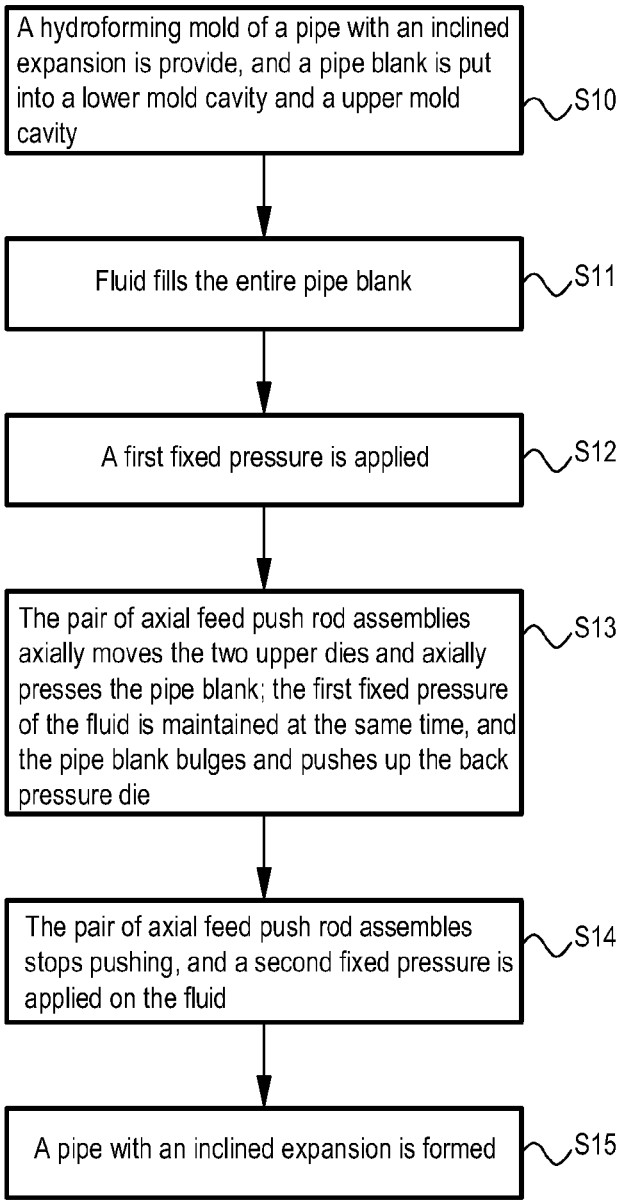
FIG. 7 is a flow chart of a method for manufacturing a pipe with an inclined expansion according to an embodiment.

FIG. 7 is a flow chart of a method for manufacturing a pipe with an inclined expansion 4. The manufacturing method includes the following steps.

The foregoing hydroforming mold 2 is provided, and a pipe blank 3 is put into the lower mold cavity 231 and the upper mold cavity 241. The mold is assembled according to connection relationships of the hydroforming mold 2, so that the hydroforming mold 2 is ready for hydroforming (S10).

A fluid pressurizing device is used to fill the fluid into the entire pipe blank 3 through the runner 261 of the pair of axial feed push rod assemblies 26, thereby exhausting the air in the pipe blank 3 (S11).

The fluid pressurizing device applies a first fixed pressure on the fluid in the pipe blank 3 (S12), where the first fixed pressure is greater than a minimum bulging stress required by the pipe blank 3 so that the pipe blank 3 begins to bulge toward the back pressure die 25.

The pair of axial feed push rod assemblies 26 moves the two upper dies 24 with a pushing speed $v_p$ and axially presses the pipe blank 3. Meanwhile, the fluid pressurizing device maintains the first fixed pressure of the fluid, and the pipe blank 3 continuously bulges under the hydraulic pressure and pushes up the back pressure die 25. The inward slope 2411 of the two upper dies 24 is used to move an upward protruding portion of the pipe blank 3 toward the frame 251, so that the upward protruding portion of the pipe blank 3 forms an inclined expansion smoothly, and the pipe wall maintains an even thickness (S13).

Figure 8:
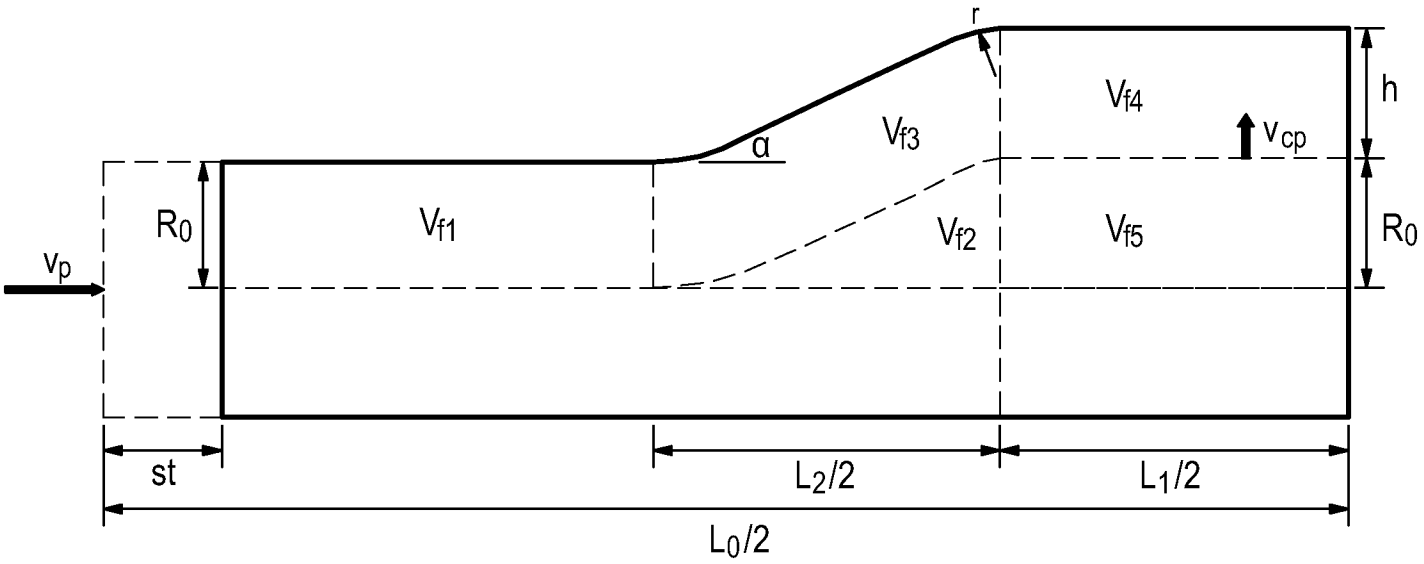
FIG. 8 is a view illustrating definitions of dimension symbols of a pipe with an inclined expansion according to an embodiment.

The pair of axial feed push rod assemblies 26 stops pushing after moving for a stroke L. At this time, the two upper dies 24, the two pressing portions 252 and the saddle portion 2512 of the frame 251 are closely connected, forming a mold cavity with an inclined expansion. Meanwhile, a second fixed pressure is applied on the fluid. The pressure value is expressed in the following formula: $P_y=(\sigma_y \times t)/r$, where r is shown in FIG. 8, and the first fixed pressure is smaller than the second fixed pressure; the second fixed pressure enables the pipe blank 3 to bulge until it is aligned with a bending portion of the mold cavity with an inclined expansion (S14).

A pipe with an inclined expansion 4 is formed; the fluid pressurizing device stops pressurizing the fluid in the pipe blank 3, and discharges the fluid out of the pipe blank 3 (S15).

In addition, after the pipe with an inclined expansion is formed (S15), a demolding step is performed. The demolding step includes: taking out the pair of axial feed push rod assemblies 26, opening the upper die holder 22 and the lower die holder 21, taking out the back pressure die 25 and the two upper dies 24, and then removing the pipe with an inclined expansion 4 from the hydroforming mold 2.

When the pair of axial feed push rod assemblies 26 moves the two upper dies 24, the internal end surfaces of the two upper dies 24 lean against external end surfaces of the two pressing portions 252, and therefore the two upper dies 24 axially push the two pressing portions 252 to move along the guide rod 2511. In addition, the two pressing portions 252 are pushed upward as the surface of the pipe blank 3 bulges upward, so that the two pressing portions 252 produce an obliquely upward movement track.

The back pressure die 252 further includes two elastic elements 253 that are sleeved on the guide rod 2511 at two sides of the frame 251, and the elastic elements are respectively located between the frame 251 and the two pressing portions 252. When the two elastic elements 253 produce an obliquely upward movement track at the two pressing portions 252, the elastic force generated by the two elastic elements 253 enables the two pressing portions 252 to continuously lean against the two upper dies 24.

FIG. 8 is a view illustrating definitions of dimension symbols of a pipe with an inclined expansion 4 according to the embodiment. The volume remains unchanged before and after hydroforming, so the length of the original pipe blank 3 can be calculated according to the dimension of the finished pipe 4.

The feeding volume is associated with a mold inlet angle α, and the volume of the finished pipe 4 changes along with the value of the mold inlet angle α. The volume of the finished pipe 4 increases as the mold inlet angle α increases. The volume remains unchanged before and after hydroforming, so when the volume of the finished pipe 4 increases, the pair of axial feed push rod assemblies 26 needs to push a bigger pipe blank 3.

The movement amount of the back pressure die 25 is determined by a protrusion height of the finished pipe 4. For example, if the radius of the pipe blank 3 is $R_0$ and the height after expansion is $R_0$+h, the stroke of the back pressure die 25 (the movement amount) is h.

Referring to FIG. 8, according to the symbol of each part of the pipe 4, the volume $V_f$ of the upper left part of the hydroformed pipe 4 is calculated as follows:

$$V_f=f(\alpha,L_1,L_2,R_0,h,st,t)=V_{f1}+V_{f2}+V_{f3}+V_{f4}+V_{f5}, \text{ where}$$

$$V_{f1}=\pi\times0.5\times[R_0+(R_0-t)]\times(L_0/2-st-L_1/2-L_2/2)\times t,$$

$$V_{f2}=0.5\times L_2\times R_0\times t,$$

$$V_{f3}=0.5\times0.5\times[R_0+(R_0-t)]\times\pi\times L_2\times t/\cos\alpha,$$

$$V_{f4}=0.5\times\pi\times0.5\times[h+(h-t)]\times L_1\times t,$$

$$V_{f5}=L_1\times R_0\times t$$

$V_{f1}$ is the volume of a first upper left part of the pipe 4, $V_{f2}$ is the volume of a second upper left part of the pipe 4, $V_0$ is the volume of a third upper left part of the pipe 4, $V_{f4}$ is the volume of a fourth upper left part of the pipe 4, and $V_{f5}$ is the volume of a fifth upper left part of the pipe 4.

Before hydroforming, the volume $V_0$ of the upper left part of the billet 3 is as follows:

$V_0=f(R_0, L_0, t)=0.5\times\pi\times0.5\times[R_0+(R_0-t)]\times t\times L_0$, where t is the thickness of the pipe blank 3, $R_0$ is the radius of the pipe blank 3, st is a stroke of the pair of axial feed push rod assemblies 26, $L_0$ is the initial length of the pipe blank 3, $L_1$ is the length of the top of the inclined expansion of the pipe 4, $L_2$ is the length of the bottom edge of the trapezoidal protrusion of the pipe 4, and h is a stroke of the back pressure die 25. Since the volume remains unchanged, $V_f=V_0$.

The two elastic elements 253 are disposed between the two pressing portions 252, that is, a gap is maintained between the two pressing portions 252. Therefore, during hydroforming, not only a feed quantity of the pair of axial feed push rod assemblies 26 but also the pressure for feeding the fluid into the pipe blank 3 needs to be controlled, so that the volume remains unchanged. If the pressure is excessive, the pipe blank 3 expands toward the gap during the hydroforming process, and is clamped by the two pressing portions 252, wasting the material.

According to the thin-wall theory, when the pair of axial feed push rod assemblies 26 does not feed, a minimum bulging stress required by the pipe blank 3 is $P_{min}$. $P_{min}=(\sigma_y \times t)/R_0$, where $\sigma_y$ is a material yielding stress of the pipe blank 3, $R_0$ is the radius of the pipe blank 3, and t is the thickness of the pipe blank 3.

Since the volume remains unchanged, $V_f=V_0$. Through calculation, the stroke st is about 43.3 mm. The speed is a ratio of distance to time. The axial feed push rod and the back pressure die start respective stroke at the same time, and use the same time to finish the stroke. Therefore, the ratio of $v_p$ to $v_{cp}$ is equal to the ratio of st to h.

$v_p$ is a pushing speed of the pair of axial feed push rod assemblies 26, and $V_{cp}$ is an initial upward speed of the back pressure die 25. When $L_1$=80 mm, $L_2$=80 mm, t=1.2 mm, α=22.16°, and h=$R_0$=12.7 mm. According to these data, it can be obtained that the stroke of the pair of axial feed push rod assemblies 26 is 43.3 mm, and the stroke of the back pressure die 25 is 12.7 mm. Therefore, $v_p$:$v_{ep}$=st:h=43.3:12.7. If the pushing speed of the pair of axial feed push rod assemblies 26 is 0.5 mm/s, the time for hydroforming the pipe 4 is 86.6 second.

Through the pipe hydroforming mold 2 of the pipe with an inclined expansion 4 together with the method for manufacturing the pipe with an inclined expansion 4, and through the two movable upper dies 24 and back pressure die 25, the pipe blank 3 can be pushed into an expansion area smoothly during a hydroforming process. In this manner, the thickness of the pipe with an inclined expansion 4 is evenly distributed. On the other hand, the pipe bulges evenly, so that the pipe blank 3 may not buckle, wrinkle or break during an expansion process.

The disclosure is disclosed in the above embodiments. However, the above embodiments are not intended to limit the disclosure. Any change, modification, and equivalent replacement made by persons skilled in the art without departing from the spirit of the disclosure shall fall within the scope of the disclosure.

What is claimed is:

1. A hydroforming mold, comprising:

a lower die holder, comprising a groove base, wherein the groove base comprises a bottom plane and two side planes adjoining the bottom plane;

a lower die, disposed on the bottom plane, wherein a lower mold cavity for receiving a pipe blank is provided on a top portion of the lower die;

a pair of upper dies, respectively clamped on the top portion of the lower die and capable of moving along the top portion of the lower die, wherein a bottom portion of each upper die is provided with an upper mold cavity, and an inward slope is formed on a side of each upper mold cavity opposite to the other upper die;

a back pressure die, disposed between the two upper dies and comprising a frame and two pressing portions, wherein the frame has a guide rod parallel to an axial direction of the pipe blank, each pressing portion is provided with a guide hole, the guide hole is sleeved on the guide rod so that the two pressing portions move relative to the frame, and bottom surfaces of the two pressing portions lean against a surface of the pipe blank;

an upper die holder, covered on the lower die holder to prevent the pair of upper dies from moving away from the lower die, wherein a window is provided on a position of the upper die holder corresponding to the back pressure die, so as to form a space that allows the back pressure die to move away from the lower die; and a pair of axial feed push rod assemblies, respectively sealed with an end portion of the pipe blank and the pair of upper dies, wherein the pair of axial feed push rod assemblies has a runner for introducing fluid into the pipe blank, and axially pushes the pair of upper dies to move close to each other.

2. The hydroforming mold according to claim 1, further comprising two plates that are respectively disposed between two external sides of the lower die and the two side planes of the groove base, wherein two opposite surfaces of the two plates foam two guide surfaces for movement of the two upper dies and the two pressing portions; and the two plates are fixed through the upper die holder to prevent the pair of upper dies from moving away from the lower die.

3. The hydroforming mold according to claim 1, wherein the back pressure die further comprises two elastic elements, the two elastic elements are sleeved on the guide rod at two sides of the frame, and respectively located between the frame and the two pressing portions.

4. The hydroforming mold according to claim 3, wherein each elastic element is a compression spring.

5. The hydroforming mold according to claim 1, wherein two elastic elements are disposed between the two pressing portions, and a gap is maintained between bottom surfaces of the two pressing portions.

6. The hydroforming mold according to claim 1, wherein the frame further comprises a saddle portion; the saddle portion is disposed on a bottom surface of the frame and leans against the surface of the pipe blank.

7. The hydroforming mold according to claim 6, wherein a gap is maintained between the saddle portion and the bottom surfaces of the two pressing portions.

8. The hydroforming mold according to claim 1, wherein the guide rod is a round rod.

9. The hydroforming mold according to claim 1, wherein the groove base has an upward opening.

10. The hydroforming mold according to claim 1, wherein the upper die holders preventing the pair of upper dies from moving away from the lower die means that the upper die holder prevents the pair of upper dies from moving upward; and the window forming the space that allows the back pressure die to move away from the lower die formed means that the window forms a space that allows the back pressure die to move upward.

11. A pipe manufacturing method, comprising:

providing a hydroforming mold, the hydroforming mold comprising:

a lower die holder, comprising a groove base, wherein the groove base comprises a bottom plane and two side planes adjoining the bottom plane;

a lower die, disposed on the bottom plane, wherein a lower mold cavity for receiving a pipe blank is provided on a top portion of the lower die;

a pair of upper dies, respectively clamped on the top portion of the lower die and capable of moving along the top portion of the lower die, wherein a bottom portion of each upper die is provided with an upper mold cavity, and an inward slope is formed on a side of each upper mold cavity opposite to the other upper die;

a back pressure die, disposed between the two upper dies and comprising a frame and two pressing portions, wherein the frame has a guide rod parallel to an axial direction of the pipe blank, each pressing portion is provided with a guide hole, the guide hole is sleeved on the guide rod so that the two pressing portions move relative to the frame, and bottom surfaces of the two pressing portions lean against a surface of the pipe blank;

an upper die holder, covered on the lower die holder to prevent the pair of upper dies from moving away from the lower die, wherein a window is provided on a position of the upper die holder corresponding to the back pressure die, so as to form a space that allows the back pressure die to move away from the lower die; and a pair of axial feed push rod assemblies, respectively sealed with an end portion of the pipe blank and the pair of upper dies, wherein the pair of axial feed push rod assemblies has a runner for introducing fluid into the pipe blank, and axially pushes the pair of upper dies to move close to each other;

putting a pipe blank into the lower mold cavity and the upper mold cavity;

filling fluid into the pipe blank through the runner;

applying a first fixed pressure on the fluid;

the pair of axial feed push rod assemblies moving the pair of upper dies in an axial direction with a pushing speed, and axially pressing the pipe blank; maintaining the first fixed pressure of the fluid at the same time, wherein the pipe blank bulges and pushes up the back pressure die;

the pair of axial feed push rod assemblies stopping pushing after moving for a stroke; at the same time, applying a second fixed pressure on the fluid, wherein the first fixed pressure is smaller than the second fixed pressure; and forming the pipe.

12. The pipe manufacturing method according to claim 11, wherein after the step of forming the pipe, a demolding step is performed so that the pipe is removed from the hydroforming mold.

13. The pipe manufacturing method according to claim 11, wherein when the pair of axial feed push rod assemblies moves the pair of upper dies, internal end surfaces of the pair of upper dies lean against external end surfaces of the two pressing portions, and therefore the pair of upper dies axially pushes the two pressing portions to move along the guide rod; the two pressing portions are pushed upward as the surface of the pipe blank bulges upward, and the two pressing portions produce an obliquely upward movement track.

14. The pipe manufacturing method according to claim 13, wherein the back pressure die further comprises two elastic elements, wherein the two elastic elements are sleeved on the guide rod at two sides of the frame, and located between the frame and the two pressing portions; when the two elastic elements produce an obliquely upward movement track on the pressing portions, the two pressing portions are enabled to lean against the pair of upper dies continuously.

15. The pipe manufacturing method according to claim 11, wherein the pipe blank is a metal material.

16. The pipe manufacturing method according to claim 11, wherein when the pair of axial feed push rod assemblies does not feed, a minimum bulging stress required by the pipe blank is $P_{min}$; $P_{min} = (\sigma_y \times t)/R_0$, $\sigma_y$ is a material yielding stress of the pipe blank, t is a thickness of the pipe blank, and $R_0$ is a radius of the pipe blank.

17. The pipe manufacturing method according to claim 11, wherein during hydrofonning on the pipe blank, a relationship between a pushing speed of the pair of axial feed push rod assemblies and an upward speed of the back pressure die is expressed as follows:

$$v_p : v_{cp} = st : h;$$

$v_p$ is the pushing speed of the pair of axial feed push rod assemblies;

$v_{cp}$ is an initial upward speed of the back pressure die;

st is a stroke of the pair of axial feed push rod assemblies; and h is a movement amount of the back pressure die.

* * * * *